United States Patent [19]

Lampe

[11] 4,387,890

[45] Jun. 14, 1983

[54] APPARATUS FOR CHANGING THE ORIENTATION OF STACKED PAPER SHEETS OR THE LIKE

[75] Inventor: Seigfried Lampe, Ellerbek, Fed. Rep. of Germany

[73] Assignee: E.C.H. Will (GmbH & Co.), Hamburg, Fed. Rep. of Germany

[21] Appl. No.: 282,923

[22] Filed: Jul. 13, 1981

[30] Foreign Application Priority Data

Jul. 14, 1980 [DE] Fed. Rep. of Germany ..... 3026634

[51] Int. Cl.[3] ..... B65H 5/00

[52] U.S. Cl. ..... 271/225; 271/184; 271/195; 198/411; 414/676; 414/903

[58] Field of Search ..... 414/676, 903; 269/20 R; 271/184, 185, 195, 225; 198/411

[56] References Cited

U.S. PATENT DOCUMENTS 3,469,887 9/1967 Nakahara ..... 414/676 X 3,822,777 9/1974 Jepsen ..... 414/676 X

*Primary Examiner*—Richard A. Schacher

*Attorney, Agent, or Firm*—Kontler, Grimes & Battersby

[57] ABSTRACT

Apparatus for changing the orientation of successive stacks of overlapping paper sheets has a first conveyor which delivers stacks seriatim onto the upper side of a support located below a vertically movable and rotatable turntable having at its underside a layer consisting of rubber and formed with openings for escape of air. The support has plenum chambers which discharge streams of compressed air against the underside of a stack between the support and the turntable whereby the stack is lifted off the support and bears against the layer at the underside of the turntable before the latter begins to rotate through 90 degrees to thus change the orientation of the stack. Prior to rotating, the turntable is moved downwardly toward and bears against the stack on the support to thereby expel air from the stack and to cause opening of valves in the upper side of the support by way of the lowermost sheet of the stack. The valves allow compressed air to escape from the plenum chambers, and such air lifts the stack to maintain the uppermost sheet of the stacks in firm contact with the underside of the turntable which is lifted through a relatively short distance prior to rotation through 90 degrees. The reoriented stacks are removed by a second conveyor which is aligned with the first conveyor and has entraining fingers movable through channels between neighboring plenum chambers of the support.

14 Claims, 3 Drawing Figures

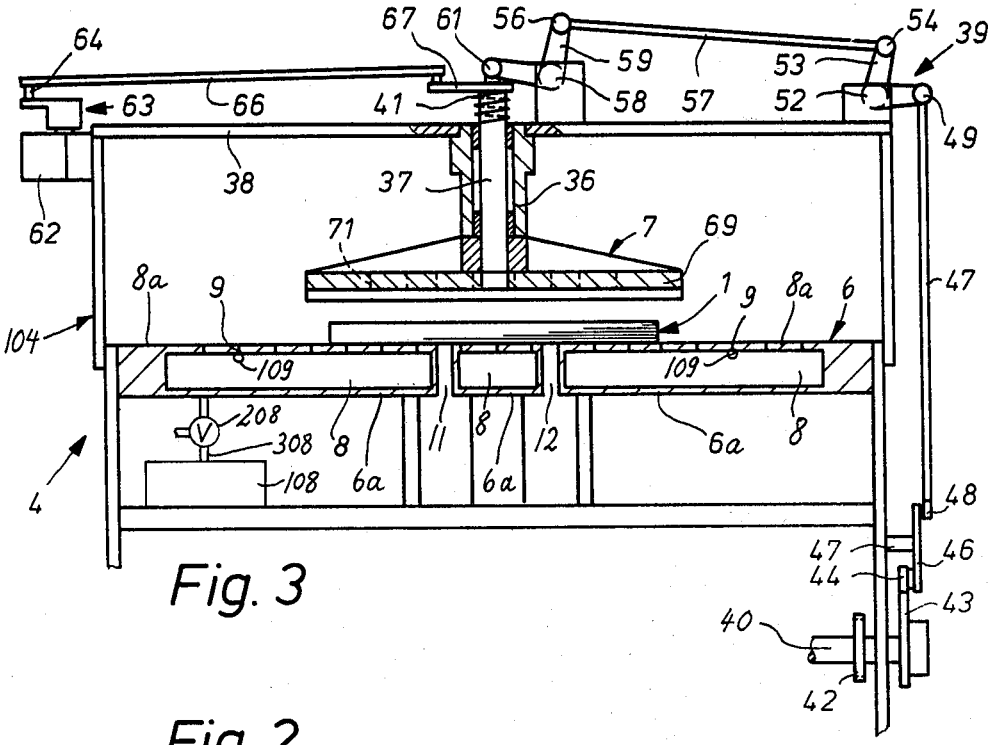
Fig. 3
Fig. 2
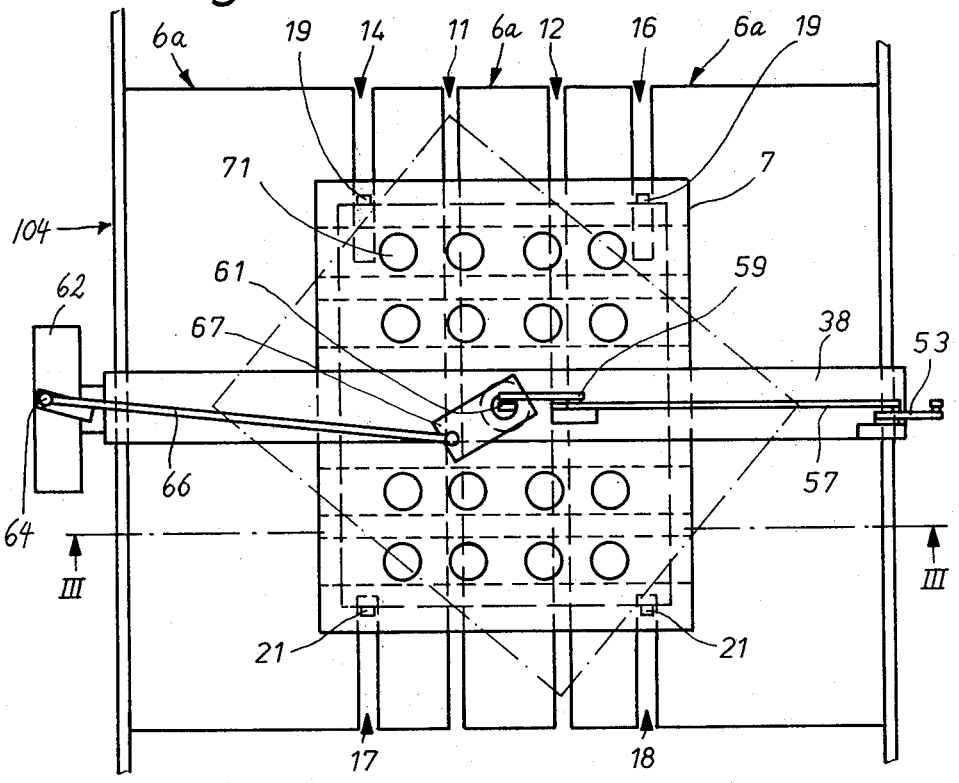

APPARATUS FOR CHANGING THE ORIENTATION OF STACKED PAPER SHEETS OR THE LIKE

BACKGROUND OF THE INVENTION

The present invention relates to apparatus for manipulating sheets which consist of paper, cardboard, metallic foil, synthetic plastic material or a combination of such substances, and more particularly to improvements in apparatus for changing the orientation of stacked sheets between successive processing stations or the like.

It is often necessary to change the orientation of (especially to rotate) stacked paper sheets or the like between a first processing station at which the stacks must be held in a first position and a next-following processing station at which proper treatment of stacks necessitates that the stacks be held in an entirely different position. For example, a stack of sheets is gathered and trimmed at a preceding station, and one edge face of each sheet in a freshly assembled stack must be coated with a suitable adhesive at the next station. The nature of the adhesive applying device at the next station may be such that the entire stack must be rotated through a certain angle about a vertical axis in order to move the selected edge faces of sheets in a stack to an optimum position for the application of adhesive. Elongated rectangular sheets can be assembled into stacks at a first station from which the freshly assembled stacks are removed by advancing the sheets lengthwise so that one shorter edge is located at the leading end of each sheet in the freshly assembled stack. On the other hand, the paster which applies adhesive to one of the shorter edge faces of each stack is adjacent to the path of lengthwise movement of the stack so that it is necessary to turn each stack through 90 degrees prior to arrival at the adhesive-applying station.

OBJECTS AND SUMMARY OF THE INVENTION

An object of the invention is to provide a novel and improved apparatus which can change the orientation of successive sheets or stacks of sheets with a high degree of accuracy, without defacing and/or otherwise damaging the sheets, and within short intervals of time.

Another object of the invention is to provide an apparatus of the just outlined character which is simpler than heretofore known apparatus, which can be utilized for changing the orientation of larger or small stacks consisting of large or small sheets, and which can be readily installed in existing production lines for exercise books, steno pads, note books or analogous stationery products.

A further object of the invention is to provide an apparatus which can treat the sheets gently, which prevents changes in orientation of sheets within successive stacks, which is compact and requires a minimum of maintenance, whose operation can be automated to a desired extent, and which can stand long periods of uninterrupted use in a production line for the mass-production of stationery products or the like.

An additional object of the invention is to provide the apparatus with novel and improved means for simultaneously turning all sheets of a large, medium-sized or small stack in a small space, by resorting to simple instrumentalities, and with a high degree of reproducibility.

An ancillary object of the invention is to provide the apparatus with novel and improved means for delivering stacks to and for removing stacks from the orientation changing station.

The invention is embodied in an apparatus for changing the orientation of sheets, particularly stacks of overlapping sheets consisting of paper, cardboard, metal, synthetic plastic material or a combination of such substances. The apparatus comprises a support, e.g., a stationary table having a substantially horizontal upper side, first conveyor means for supplying sheets to the support (i.e., onto the horizontal or nearly horizontal upper side), second conveyor means for removing reoriented sheets from the support, an orientation changing device (preferably a turntable) mounted at a level above the support and rotatable about a substantially vertical axis (preferably about the central vertical symmetry axis of the device), and means for pneumatically lifting a sheet or a stack of sheets off the support and for urging the thus lifted sheet or stack of sheets against the orientation changing device so that the lifted sheet or the stack of lifted sheets can share the rotary movements of the orientation changing device about the vertical axis. The apparatus preferably further comprises means for moving the orientation changing device up and down, i.e., away from and toward the support. For example, the arrangement may be such that the orientation changing device is moved down against the upper side of a stack of sheets on the support to expel air from the stack, that the device is thereupon slightly lifted so as to allow for lifting of the stack of sheets above and away from the stationary support, that the device is thereupon rotated while the uppermost sheet of the stack is urged against its underside, that the lifting action is terminated in the next step, that the orientation changing device is thereupon raised to its upper end position so as to allow for convenient removal of the treated stack, and that the stack is thereupon removed by the second conveyor means.

The apparatus further comprises means for indexing the orientation changing device, e.g., through angles of 90 degrees. If desired, the orientation changing device can be indexed in a single direction. Alternatively, the device can be rotated in a first direction to change the orientation of the stack therebelow through a selected angle, and the device is thereupon rotated in the opposite direction to reassume its original or starting position. The means for moving the orientation changing device up and down may comprise one or more springs or analogous means for yieldably biasing the device upwardly, and a linkage with a pusher or analogous means for moving the device downwardly against the opposition of the biasing means. In order to ensure gentle treatment of the sheets as well as to reduce the likelihood of angular displacement of the device relative to the sheets of the stack therebelow while the stack is lifted by pneumatic means, the orientation changing device may comprise a plate-like layer which is disposed at its underside and consists of rubber or another suitable elastomeric material. Such layer may have one or more venting openings therein to allow for escape of air which is expelled from the stack in response to downward movement of the orientation changing device and/or in response to upward movement of a stack in response to the application of compressed air against the underside of the lowermost sheet.

The lifting means may comprise at least one plenum chamber which is provided in or which may constitute the support and can discharge streamlets of compressed air or another suitable gaseous fluid by way of ports which are provided in the support and are normally closed by suitable valves, e.g., valves employing spherical valving elements which are depressible by a stack of sheets thereon, for example, while the orientation changing device bears against the topmost sheet of the stack on the support. All that counts is to ensure that the valves open preparatory to lifting of the sheets above the support and against the underside of the orientation changing device. As mentioned above, the orientation changing device can be moved to its lower end position to expel air from a stack of sheets therebelow and is thereupon lifted to a certain extent so as to provide room for lifting of the stack above and away from the support. The valves can be opened during the last stage of movement of the orientation changing device to its lower end position but the streamlets of compressed air are capable of lifting the stack off the support only when the orientation changing device is lifted above and away from its lower end position to an intermediate position in which the lowermost sheet of the stack below the orientation changing device continues to maintain the valves in at least partly open positions so that the streamlets of air can cause the stack to "float" above the support even though its lowermost sheet may remain in contact with the spherical valving elements. This does not entail any undesirable shifting of the lowermost sheet with reference to the neighboring sheet or sheets of the stack because the frictional engagement between the apieces of spherical valving elements and the underside of the lowermost sheet is negligible and, furthermore, the valving elements can rotate in their ports since they are at least slightly remote from their seats.

The apparatus preferably further comprises stop means which can be moved into the path of an oncoming sheet or stack of sheets to properly locate the sheet or stack of sheets on the support preparatory to descent of the orientation changing device.

The first conveyor means is arranged to advance the sheets to the support along a first path, and the second conveyor means removes reoriented sheets along a second path which is preferably aligned with the first path. The two conveyor means may form part of a common endless conveyor, such as a chain conveyor, and each of these conveyor means can comprise a set of fingers or analogous entraining means. The fingers of the first conveyor means push successive sheets or stacks of sheets onto the support, and the fingers of the second conveyor means push reoriented sheets or stacks of sheets off the support, e.g., to a packing station, to a station where certain sides of the stacks are coated with adhesive, to a station where selected marginal portions of the stacks are formed with perforations for insertion of spiral wire binders, or to another destination. The entraining elements of the second conveyor means are preferably movable in channels which are defined by two or more sections of the support (e.g., by two or more discrete plenum chambers). Such channels enable the entraining elements of the second conveyor means to engage the rear edge faces of sheets and to move across the reorienting station during removal of reoriented sheets from the support. At such time, the orientation changing device is preferably held in its upper end position to avoid interference with orderly removal of reoriented commodities.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a plan view of the apparatus; and

FIG. 3 is a vertical sectional view as seen in the direction of arrows from the line III—III of FIG. 2.

DESCRIPTION OF THE PREFERRED EMBODIMENTS

Figure 1:
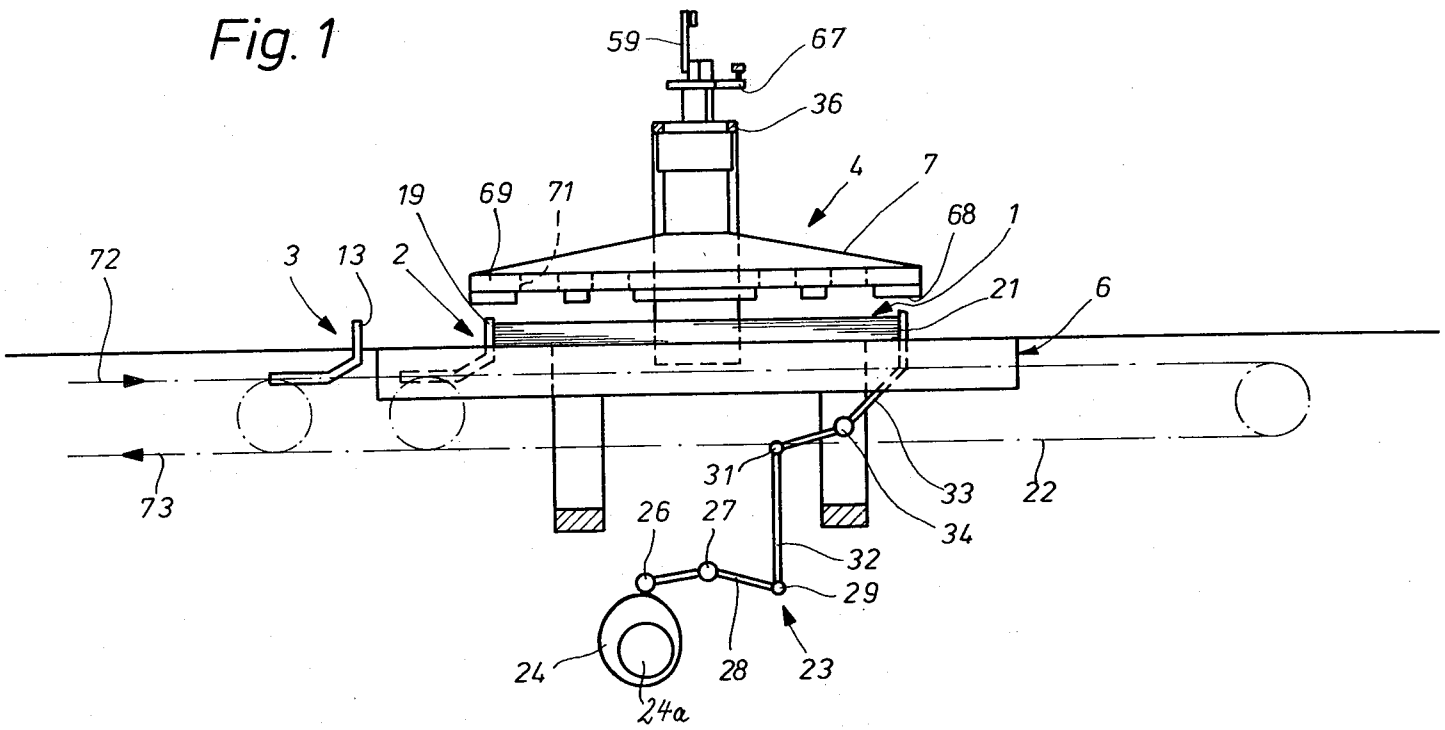
FIG. 1 is a schematic partly elevational and partly longitudinal vertical sectional view of an orientation changing apparatus which embodies one form of the invention.

The illustrated apparatus is designed to change the orientation of successive stacks 1 of overlapping paper sheets by turning each stack through 90 degrees about a vertical or nearly vertical axis, i.e., about an axis which is normal to the planes of its sheets. The apparatus comprises a feeding or supplying conveyor 2 serving to deliver successive stacks 1 to an orientation changing station 4, and a second or removing conveyor 3 serving to remove reoriented stacks 1 from the station 4. The station 4 is disposed between a stationary support 6 in the form of a table or platform which is located below the path of movement of stacks 1 with the upper reaches of the conveyors 2 and 3, and a rotary or indexible orientation changing device in the form of a turntable 7 which is disposed at a level above the stack 1 on the support 6.

As can be seen in FIGS. 2 and 3, the support 6 consists of several hollow sections 6*a* each of which has a plenum chamber 8 with a top wall 8*a* provided with air discharging ports 9. The support 6 is mounted in the frame 104 of the orientation changing apparatus. A freshly delivered stack 1 of superimposed paper sheets or the like rests on the upper side of the support 6 before the valves 109 in the ports 9 are opened to allow streamlets of compressed air to issue from the chambers 8 whereby such streamlets lift the stack 1 above and away from the upper side of the support 6 so that the stack actually floats above the top walls 8*a*. The plenum chambers 8, the ports 9 and the valves 109 (with associated means 108 for supplying compressed air into the chambers 8) together constitute a means for pneumatically lifting the lowermost sheet of the stack 1 off the support 6 and for urging the uppermost sheet of such stack against the underside of the turntable 7 thereabove. The valves 109 preferably comprise spherical valving elements, e.g., of the type disclosed in commonly owned U.S. Pat. No. 4,237,674 granted Dec. 9, 1980 to Kurt Aykut. For the sake of convenience, the disclosure of this patent is incorporated herein by reference. When a spherical valving element is depressed against the opposition of a valve spring, it allows compressed air to escape from the respective chamber 8, and such air lifts the lowermost sheet of the stack 1 off the respective top wall 8*a*.

FIGS. 2 and 3 further show that the sections 6*a* of the support 6 define two continuous uninterrupted channels 11 and 12 which extend all the way across the support and provide paths for the entraining elements 13 of the removing conveyor 3. These entraining elements constitute suitably bent fingers or prongs which can engage the rear edge face of a reoriented stack 1 while advancing through the slots 11, 12 and to thereby remove the reoriented stack from the station 4, e.g., for transfer onto a further conveyor (not shown) which delivers reoriented stacks to the next processing station.

The support 6 is further formed with relatively short slots 14, 16 at one side and 17, 18 at the other side of the station 4. The slots 14, 16 and 17, 18 flank the continuous channels 11, 12 and serve to respectively provide room for entraining elements 19 on the first conveyor 2 and for retractible stops 21. The slots 14, 16 for the entraining elements 19 are provided in the left-hand marginal portion of the support 6, as viewed in FIG. 1, and the slots 17, 18 for the stops 21 are formed in the right-hand marginal portion, again as viewed in FIG. 1.

The conveyors 2 and 3 preferably form two portions of an endless chain conveyor 22 which is installed at a level below the support 6. The manner in which the entraining elements 19 and 13 emerge above the upper reach of the chain conveyor 22 to respectively advance a stack 1 toward the station 4 and a stack away from such station is not specifically shown because it forms no part of the present invention. Reference may be had again to the aforementioned commonly owned U.S. Pat. No. 4,237,674 to Aykut. The entraining elements 13 and 19 are pivotably connected to the reaches of the chain conveyor 22 to be pivoted to operative or retracted positions at appropriate intervals, i.e., to advance fresh stacks 1 to the station 4 and to remove reoriented stacks from such station.

The stops 21 serve to accurately position a stack 1 at the orientation changing station 4 before such stack is lifted off the top walls 8*a* and biased against the underside of the turntable 7. The means for moving the stops 21 to and from the extended or operative positions (see the stop 21 which is shown in FIG. 1) comprises a linkage 23 which receives motion from a rotary disc-shaped cam 24. The shaft 24*a* of the cam 24 is driven by the machine or production line which embodies the improved apparatus in synchronism with movements of other movable parts to ensure rapid and reproducible changes of orientation. The linkage 23 comprises a two-armed lever 28 one arm of which carries a roller follower 26 tracking the periphery of the cam 26 and which is pivotable on or with a horizontal shaft 27 mounted in the frame 104 of the apparatus. The other arm of the lever 28 is articulately connected with the lower end portion of a link 32 by a pivot member 29. A similar pivot member 31 connects the upper end portion of the link 32 with one arm of a second lever 33 which is pivotable about the axis of a fixed shaft 34 and the other arm of which carries a stop 21. The apparatus can comprise two stops 21, i.e., it then also comprises two levers 33 each of which supports or embodies a discrete stop 21. The levers 33 can move the stops 21 into the slots 17, 18 of the support 6 to thereby arrest and locate an oncoming stack 1 in an optimum position with reference to the valves 109 and/or turntable 7. A certain amount of lost motion is provided in the linkage 23 to allow the cooperating parts 28, 32, 33 to pivot with reference to each other in response to rotation of the cam 24.

The turntable 7 is movable up and down in a vertical tubular guide sleeve 36 which is mounted on a crosshead 38 of the frame 104. The weight of the turntable 7 is carried by a vertical shaft 37 which is rotatably and axially movably guided in the sleeve 36 so that it can index the turntable through angles of 90 degrees and that it can also move the turntable up and down, namely, between an upper end position which is shown in FIG. 1 and in which the underside of the turntable is remote from the topmost sheet of the stack 1 resting on the support 6, and a lower end position in which the underside of the turntable bears against the topmost sheet of such stack and expels air (if any) from between the neighboring sheets or panels of the stack. The axis of the shaft 37 preferably coincides with the central vertical symmetry axis of the turntable 7.

The means for moving the turntable 7 up and down comprises a helical restoring spring 41 which surrounds the upper portion of the shaft 37 at a level above the sleeve 36 and reacts against the latter. The upper end convolution of the spring 41 bears against a crank arm 67 which is rigidly secured to the shaft 37 and forms part of the means for indexing the shaft 37 (and hence the turntable 7) through angles of 90 degrees. The means for moving the turntable 7 up and down further comprises a shifting mechanism 39 including a gear 42 receiving torque from the main prime mover of the production line through the medium of a driver gear, gear train or chain conveyor, not shown. The shaft 40 for the gear 42 is rigid with a disc-shaped cam 43 whose peripheral surface is tracked by a roller follower 44 on one arm of a lever 46 pivotable about the axis of a horizontal shaft 47 which is affixed to or journalled in the frame 104. The upper arm of the lever 46 is articulately connected with the lower end portion of a motion transmitting link 47 by a pivot member 48. A similar pivot member 49 connects the upper end portion of the link 47 with one arm of a bell crank lever 53 which is pivotable about the axis of a horizontal shaft 52 on the crosshead 38 and the other arm of which is articulately connected with a second link 57 by a pivot member 54. An additional pivot member 56 connects the left-hand end portion of the link 57 (as viewed in FIG. 2) with one arm of a bell crank lever 59. The lever 59 is pivotable about the axis of a horizontal shaft 58 which is supported by the crosshead 38, and the second arm of the lever 59 carries a roller 61 which bears against the upper end face of the shaft 37 for the turntable 7. Thus, as the cam 43 rotates, it causes the roller 61 to move down and to thereby depress the shaft 37 against the opposition of the spring 41, and to thereupon rise whereby the spring 41 expands and lifts the turntable 7 through the medium of the shaft 37 which slides in the sleeve 36. It will be noted that the construction of the shifting mechanism 39 is analogous to that of the linkage 23 for the stops 21.

The indexing means 63 for rotating the shaft 37 through angles of 90 degrees comprises a prime mover 62 (e.g., an electric motor) which is mounted on the crosshead 38 and drives a crank unit having an eccentric pin 64 coupled to one end portion of a link 66 the other end portion of which is coupled to the aforementioned crank arm 41 which is rigid with the shaft 37 and also serves as an abutment for the spring 41.

The turntable has a plate-like layer 69 which carries or embodies elastic projections or ribs 68 facing the support 6. The layer 69 has venting openings 71 which allow for escape of air that has been expelled from the stack 1 on the support 6 in response to movement of the turntable 7 to its lower end position. The distribution of ribs 68 and openings 71 is shown in FIG. 2. The ribs 68 may consist of natural or synthetic rubber or any other suitable elastomeric material which is not likely to damage or deface the uppermost sheets of successive stacks.

The operation of the improved orientation changing apparatus is as follows:

The entraining elements 19 of the conveyor 2 deliver successive stacks 1 onto the support 6 in rhythm with operation of the production line which includes the apparatus. An oncoming stack 1 is advanced in the direction indicated by arrow 72 and is moved against the stops 21 which are then maintained in the raised or operative positions corresponding to that of the stop 21 shown in FIG. 1. In other words, the stops 21 extend into the respective slots 17, 18 of the support 6 to arrest the oncoming stack 1 in an optimum position with reference to the ports 9, valves 109 and turntable 7. In the next step, the cam 24 causes the stops 21 to descend so that they cannot interfere with downward movement of the turntable 7 to its lower end position in which the ribs 68 bear against the uppermost sheet of the stack 1 on the support 6 and thereby expel air from such stack. Expelled air is allowed to escape from the apparatus via venting openings 71 in the plate-like layer 69 of the turntable 7. Downward movement of the turntable 7 to its lower end position is effected by the cam 43 in cooperation with other component parts of the shifting mechanism 39 and against the opposition of the spring 41 which then stores additional energy and is ready to lift the turntable 7 as soon as the roller 61 begins to rise. The entraining elememts 19 of the conveyor 2 are also retracted by descending through the respective slots 14, 16 of the support 6 so that they, too, cannot interfere with the just described movement of the turntable 7 to its lower end position. As mentioned above, one mode of mounting entraining elements for pivotal movement relative to an endless conveyor, such as the chain conveyor 22 which includes the conveyors 2 and 3 of the improved apparatus, is disclosed and shown in the aforementioned commonly owned U.S. Pat. No. 4,237,674 to Aykut. Reference may also be had to German Offenlegungsschrift No. 2,729,456 which discloses a different mode of securing entraining elements to a chain conveyor or the like.

When deposited on the support 6, a freshly arrived stack 1 is assumed to be held in such position that the shorter sides of its sheets extend transversely of the direction of transport of the stack by the conveyor 2 and/or conveyor 3. In FIG. 1, the longer sides of sheets which form the stack 1 extend in the direction which is indicated by the arrow 72, and the shorter sides extend at right angles to the plane of FIG. 1.

The extent of downward movement of the turntable 7 is preferably adjustable so that this turntable can properly "squeeze" or compact relatively high, medium-sized or low stacks. At any rate, the lower end position of the turntable 7 is selected in such a way that the ribs 68 ensure complete or nearly complete expulsion of air from the stack 1 therebelow. As explained above, expelled air can be evacuated through the grooves or passages between neighboring ribs 68 and the venting openings 71 in the layer 69. During such stage of the reorienting operation, the plenum chambers 8 in the sections 6a of the support 6 are connected to the atmosphere via valve 208 so that the depression of valving elements in the valves 109 does not entail any flow of compressed air against the underside of the lowermost sheet of the stack 1 below the turntable 7.

The rotating cam 43 thereupon lifts the roller 61 to a certain extent whereby the spring 41 immediately expands and lifts the turntable 7 from the lower end position upon completion of the air-expelling step. Thus, the pressure upon the stack 1 below the ribs 68 is relaxed. At the same time, the valve 208 in a conduit means 308 connecting the source 108 of compressed air with the chambers 8 admits compressed air which escapes via ports 9 because these ports are partially open by the spherical valving elements of the valves 109 which remain partially depressed by the stack 1 while the turntable 7 is held only slightly above its lower end position. This will be readily appreciated by looking at FIG. 8 of the aforementioned U.S. Pat. No. 4,237,674 to Aykut.

The streamlets of compressed air which issue from the chambers 8 via ports 9 from an air cushion which extends between the lowermost sheet of the stack 1 and the upper sides of the top walls 8a whereby the cushion practically eliminates friction between the underside of the lowermost sheet of the stack and the support 6 and/or valves 109 while urging the uppermost sheet of the stack against the ribs 68 of the turntable 7. The cam 43 is preferably arrested for a given interval of time, or its peripheral surface is configurated in such a way that the roller 61 dwells at a predetermined level in which the turntable 7 is held in an intermediate position such that the lowermost sheet of the stack 1 therebelow maintains the valves 109 in slightly open positions so that the escaping compressed air can form the aforediscussed cushion. During such interval of retention of turntable 7 at a predetermined level at which the valves 109 are slightly open, the motor 62 causes the crank unit of the indexing means 63 to pivot the crank arm 41 about the axis of the shaft 37 which rotates through 90 degrees and causes a corresponding angular displacement of the turntable 7 with the suspended stack 1 therebelow. This results in such change of orientation of the stack 1 that the shorter sides of its sheets are parallel with the direction which is indicated by the arrow 72 so that one of such shorter sides can be coated with adhesive while the reoriented stack 1 moves away from the station 4.

The conveyor 3 removes the reoriented stack 1 after the turntable 7 reassumes or moves close to its upper end position under the action of the retoring spring 41. This provides room for the tips of the entraining elements 31 which advance through the respective channels 11, 12 and remove the stack 1 from the station 4. The means for starting and arresting the motor 62 and the drives for the conveyor 2, 3 is not specifically shown in the drawing; such means is operated in synchronism with the remaining movable parts of the production line so as to ensure timely removal of stacks from the station which precedes the station 4 and timely transfer or reoriented stacks 1 to the station which follows the station 4. The illustrated distance between the entraining elements 13 and 19 of FIG. 1 corresponds to the difference between the lengths of the shorter and longer sides of a sheet forming part of the stack 1.

The turntable 7 is thereupon rotated back to its starting position so that it is ready for the next orientation changing operation. While the conveyor 2 advances the next stack 1 to the station 4, the linkage 23 causes the stops 21 to reassume their operative or extended positions so as to arrest the arriving stack in an optimum position with reference to the turntable 7.

The entraining elements 13 of the removing conveyor 3 descend to a level below the support 6 upon completion of transfer of a freshly reoriented stack 1 to the next station and thereupon advance back to their starting positions by moving with the lower reach of the conveyor 22 in the direction indicated by arrow 73.

It is clear that the improved apparatus is susceptible of many additional modifications. For example, the mechanism 39 and spring 41 can be replaced by other means for effecting up and down movements of the turntable 7, e.g., by a mechanism which positively moves the shaft 37 up and down so that the intermediate positions of the turntable 7 (in which the turntable rotates about the axis of the shaft 37) can be selected with an even higher degree of accuracy. Also, the elastomeric ribs 68 can be replaced by or used together with other skid-resisting means which reduce the likelihood of rotation of the turntable 7 relative to the stack of sheets therebelow. The provision of means for permitting escape of air which is expelled from the stack 1 below the turntable 7 also contributes to more reliable engagement between the top most sheet of the stack above the support 6 and the underside of the turntable.

The cam 24 can be replaced with a differently configurated and/or dimensioned cam if the apparatus is to change the orientation of stacks consisting of sheets which are larger or smaller than the illustrated sheets.

An important advantage of the improved apparatus is that the relatively sensitive edge positions of sheets which form a stack need not be engaged by the support 6 and/or turntable 7 so that the likelihood of deformation of sheets during treatment at the station 4 is practically nil. In many heretofore known orientation changing apparatus, the marginal portions of a stack are engaged by tongs or analogous gripping means which are much more likely to deform the edge portions of sheets and/or to leave other marks than the elastic ribs 68 at the underside of the turntable 7. The upper side of the uppermost sheet of a stack 1 above the support 6 is much less sensitive than the edge portions of the sheets and, moreover, such upper side is engaged by the elastically deformable ribs 68 so that the likelihood of deformation, defacing and/or damage to the stack is very remote. The cushion of air below the stack 1 which is in the process of being rotated with the turntable 7 reduces friction between the underside of the lowermost sheet and the adjacent parts (the spheres of the valves 109) to a value which is negligible and does not result in any damage to or deformation of the lowermost sheet of the stack.

Another important advantage of the improved apparatus is that it occupies little room, that it can be readily installed in existing production lines for note books, exercise books, steno pads or analogous commodities, and that its movable parts can be actuated by simple and inexpensive drive means. During a change or orientation, a stack of sheets above the support 6 is effectively engaged by a single component, namely, by the turntable 7 whose underside is elastic so that the number of sheets which could be defaced is reduced to one, namely, to the uppermost sheet of the stack because such uppermost sheet is the only one to come in direct contact with the turntable.

A further advantage of the improved apparatus is that it can expel air from the interior of a stack before the reorienting operation begins. This obviates the need for a discrete compressing or compacting device which is necessary in conventional reorienting apparatus for paper stacks or the like. Expulsion of air from successive stacks is desirable for several reasons, e.g., because it allows for more accurate stacking of superimposed sheets and also because the dimensions of the stack conform more accurately to a desired norm. Such conformance to norm is often desirable at the stations which follow the reorienting station 4.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for changing the orientation of sheets, particularly of stacks of overlapping sheets, comprising a support; first conveyor means for supplying sheets to said support; second conveyor means for removing sheets from said support; an orientation changing device mounted at a level above said support and rotatable about a substantially vertical axis; and means for pneumatically lifting a sheet off said support and for urging the thus lifted sheet against said device so that the lifted sheet can share the rotary movements of said device about said axis.

2. The apparatus of claim 1, further comprising means for moving said device up and down away from and toward said support.

3. The apparatus of claim 2, wherein said axis is a central vertical symmetry axis of said device.

4. The apparatus of claim 2, further comprising means for indexing said device about said axis through angles of 90 degrees.

5. The apparatus of claim 2, wherein said means for moving said device up and down comprises means for yieldably biasing said device upwardly and means for moving said device downwardly against the opposition of said biasing means.

6. The apparatus of claim 2, wherein said device comprises a sheet-contacting layer of elastomeric material.

7. The apparatus of claim 6, wherein said layer consists of rubber.

8. The apparatus of claim 2, wherein said device includes a sheet-containing layer and said layer has venting openings therein.

9. The apparatus of claim 2, wherein said lifting means comprises at least one plenum chamber provided in said support, ports provided in said support and communicating with said plenum chamber, and valve means provided in said ports to normally seal said ports, said valve means being arranged to open preparatory to lifting of sheets off said support and against said device.

10. The apparatus of claim 2, further comprising mobile stop means provided at said support for locating sheets which are delivered by said first conveyor means.

11. The apparatus of claim 2, wherein said first conveyor means is arranged to advance sheets to said support along a first predetermined path and said second conveyor means is arranged to remove sheets from said support along a second predetermined path which is in register with said first path.

12. The apparatus of claim 1, further comprising an endless conveyor, said first conveyor means forming part of said endless conveyor and including first entraining means for advancing sheets onto said support, said second conveyor means also forming part of said endless conveyor and having second entraining means for removing sheets from said support.

13. The apparatus of claim 1, wherein said second conveyor means comprises entraining elements arranged to remove sheets from said support and said support has a plurality of sections defining channels for said entraining elements.

14. The apparatus of claim 13, wherein each of said sections has at least one air chamber forming part of said lifting means.

* * * * *